United States Patent [19]

Katzin

[11] Patent Number: 4,556,325

[45] Date of Patent: Dec. 3, 1985

[54] COMPARTMENTALIZED DYNAMIC MIXING APPARATUS

[76] Inventor: Leonard Katzin, 204 S. Swall Dr., Beverly Hills, Calif. 90211

[21] Appl. No.: 539,620

[22] Filed: Oct. 6, 1983

[51] Int. Cl.[4] ..... B01F 7/16; B65D 23/04

[52] U.S. Cl. ..... 366/130; 206/219; 206/221; 366/279

[58] Field of Search ..... 366/96–98, 366/129, 130, 279, 174, 244–251, 602, 605; 206/219–222, 568, 816

[56] References Cited

U.S. PATENT DOCUMENTS 4,193,698 3/1980 Gartner ..... 366/130

FOREIGN PATENT DOCUMENTS 2244600 3/1973 Fed. Rep. of Germany ..... 206/220

*Primary Examiner*—Timothy F. Simone

*Attorney, Agent, or Firm*—Fraser and Bogucki

[57] ABSTRACT

Apparatus for storing and selectively mixing at least two distinct substances in a common package has a container (10) for creating a substance holding chamber (16) in which is disposed a barrier (18) arranged for separating the chamber into at least two compartments (20, 22) each holding a predetermined quantity of a substance different from a substance being held in the other compartment. Provision is made for exerting an external force on the barrier so as to open same and cause communication between the compartments. Subsequent mixing of the substances contained in the compartments is achieved either by continued movement of the barrier or by a separate mixing device.

16 Claims, 14 Drawing Figures

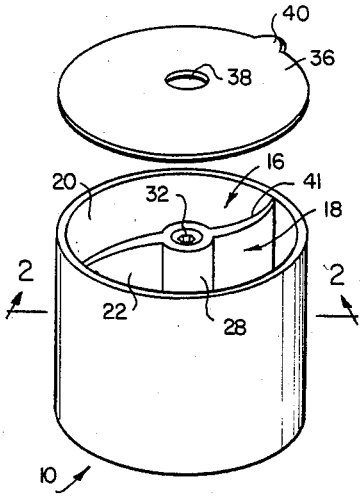
FIG. 1
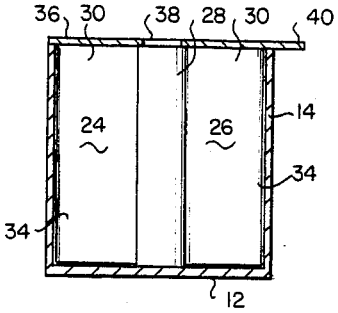
FIG. 2
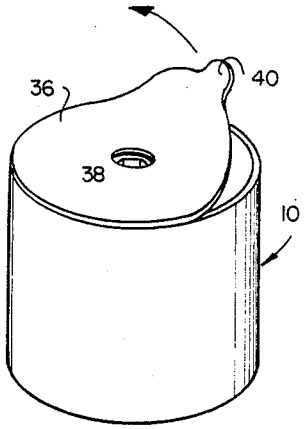
FIG. 3
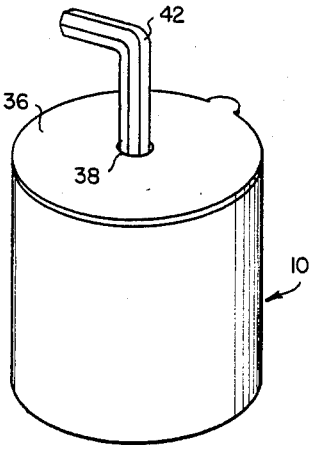
FIG. 4
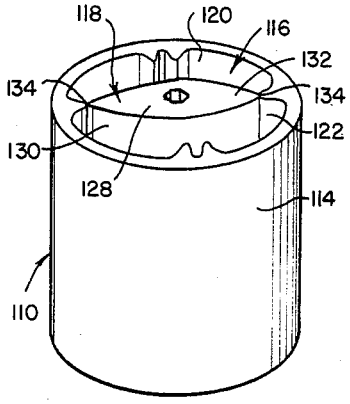
FIG. 5
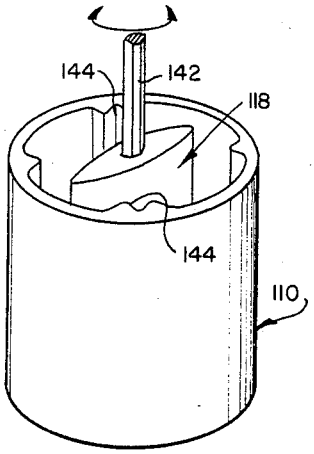
FIG. 6
FIG. 7
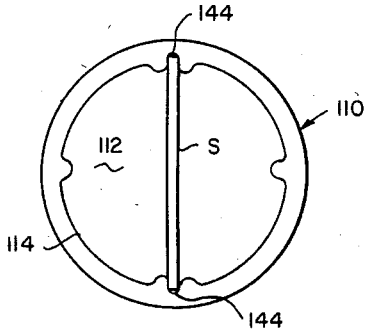

COMPARTMENTALIZED DYNAMIC MIXING APPARATUS

BACKGROUND OF THE INVENTION

1. Field of the Invention

This invention relates generally to the storage and use of two or more components to be mixed together, and more particularly to the storage and mixing of precise amounts of two or more components to be mixed together.

2. Description of the Prior Art

Polymeric materials such as epoxies, polyurethanes, and the like, are widely used in many industries. These materials, which are used as adhesives, encapsulants, fillers, sealants, protective coatings, and in many other ways, generally are available in a large range of physical, chemical, electrical, and thermal properties which can be tailored to an intended usage.

The aforementioned materials normally comprise two or more components that cause a chemical reaction to take place once they are mixed. Thus, the components usually are not mixed together until the resulting mixture is ready to be used, inasmuch as the aforementioned reaction, referred to as polymerization, changes the mixture irreversibly in a comparatively short time. The time between the mixing activity and a final "curing" of the mixture must be used for applying the material as intended. Basically, the mixed components are transformed into a solid by a solidification process which can be as short as a few seconds or as long as many hours after the initial mixing of the components. For this reason, such materials are sold, packaged, and stored in an unmixed state.

It is possible to slow down, and even stop the aforementioned solidification process by lowering the temperature of the mixed components. This requires the use of such substances as dry ice, refrigeration equipment, cryogenic materials, and the like, which are expensive and/or difficult to use. As a result, this manner of slowing the solidification process is not particularly popular.

As an alternative to slowing the mixing process by lowering the temperature of the components, it is commonplace to refrain from mixing the components until they are ready to be applied in some manner. At this time, proper amounts of each component are measured in some manner and mixed together. Often this entails holding a pair of tubes, one in each hand, and squeezing estimated amounts of each of the components into an area to be bonded, foamed, and the like.

Various devices have been proposed for facilitating the mixing action. For example, it is known to use specially constructed dual-compartment plastic tubes, separated internally by an external clamp. When the clamp is removed from the tube, the chemical components within the tube can be manually mixed together by a kneading action on the outside of the otherwise sealed tube. It also is known to use dual syringes for metering equal amounts of the, for example, two substances being employed. This arrangement, usually employed for only small amounts as needed, requires that the metered substances subsequently be manually mixed together.

Alternatively, dual syringe-type packages are known which have a plastic static blender in the form of crisscrossing screw threads attached to an output end of the device. When the syringes are evacuated through the static blender, the, for example, two components cross fluid paths perhaps as many as thirty times, thus effecting a mixing action. Among problems encountered with this known system are the high cost of the package itself, the less than good mixing obtained, and the loss of the material that inherently remains within the static blender.

In large scale manufacturing situations, there is known automated metering and mixing machines. A principal disadvantage of these machines is that they are suitable only for continuous operation situations, and further must be purged and cleaned at the end of each manufacturing run.

Further, the dental professions commonly use a dental amalgam packaged in a small packet, or capsule, of multiple compartments which are joined together by shaking or squeezing the packet. Typically, these constructions include a small container in the form of a capsule which holds a powdered alloy filling dosage and a rupturable chamber holding liquid mercury. See, for example, U.S. Pat. Nos. 3,841,467, issued October 15, 1974, to D. A. Hansen, and 4,306,651, issued Dec. 22, 1981, to E. Muhlbau. A basic disadvantage with these capsule constructions, however, is that they are suitable only for minute quantities of substances to be mixed. Often, the quantities to be mixed are such as to make such hand-shaking, or vibrating, impractical. Further, the substance within the capsule should be a heavy material, such as mercury.

U.S. Pat. No. 4,353,463, issued Oct. 12, 1982, to R. W. Seemann, discloses a resin-containing cartridge assembly for applying multi-component curable mixtures to a substrate with at least one curable component disposed in a pressure rupturable container. A liquid-permeable mixer assembly is arranged at one end of the container, with an arrangement for selectively rupturing the container disposed adjacent to the mixer assembly. A nozzle disposed adjacent an exit end of the mixer assembly permits selective discharge of the resulting mixture. A basic disadvantage of these pressure-type of mixing containers is that a suitable mixing action is not always obtained prior to discharge of the mixed components.

SUMMARY OF THE INVENTION

It is an object of the present invention to provide apparatus for storing and selectively mixing at least two distinct substances in a simple and efficient manner.

It is another object of the present invention to provide apparatus for storing two components to be mixed together, and permitting the components to be mixed at a selected time by a positive mixing action while still within the apparatus.

A still further object of the present invention is to provide a combination storage container and mixing chamber for two or more components to be mixed together, which apparatus does not require any special handling or lowering of temperature to achieve the desired results.

These and other objects are achieved according to the present invention by providing apparatus for storing and selectively mixing at least two distinct substances, the apparatus comprising a container arranged for creating a substance holding chamber, and a barrier arrangement disposed within the chamber of the container for separating the chamber into at least two compartments, with each of the compartments holding a quantity of a substance different from a substance being held in each of the other of the compartments. A combining arrangement associated with the barrier arrangement permits selective communication with one another by external force of the compartment formed by the barrier arrangement within the chamber of the container. This communication allows a substance within each of other compartments formed by the barrier arrangement. The barrier normally is attached to a wall of the container, and is arranged for dividing the chamber of the container into the aforementioned at least two compartments. The combining arrangement permits selective opening, or severance of the barrier with respect to the container.

The combining arrangement includes an actuator operable by an external force for permitting selective opening of the barrier with respect to the container. Advantageously, the combining arrangement further includes a tearing system attaching the barrier to the container for facilitating severance of the barrier from the container.

The actuator preferably includes the barrier being a single element provided with a socket opening externally of the container and arranged for receiving a wrench or other suitable tool which facilitates twisting of the element forming the barrier relative to the container and causing the desired separation between the barrier and container.

The element forming the barrier can be disposed either vertically or horizontally within the container, or at any angle between vertical and horizontal, and can have associated therewith either a vertically disposed hub or stem, depending on the orientation of the barrier element. Further, in one preferred embodiment of the invention, the barrier also forms a mixing device actuable by the same external force which opens the compartments formed by the barrier to one another for blending each substance within the compartments with one another. Alternatively, a further embodiment of the present invention provides a separate mixing element which although actuated by the same external force as mentioned above, is a separate and distinct member from the barrier element.

Another preferred embodiment of the present invention provides a barrier arrangement in the form of a vessel disposed within the chamber of the associated container and arranged forming one of the compartments of the chamber. This vessel, which is anchored to the container at a point distant from the aforementioned socket or other system for applying an external force, can be provided with a tearing system, such as a weakened area or scored tear lines, will be itself opened upon a twisting movement applied to it in order to mix the contents of the vessel with those of the container chamber surrounding the vessel.

BRIEF DESCRIPTION OF THE INVENTION

A better understanding of the invention may be had by reference to the following description, taken in conjunction with the accompanying drawings, in which:

FIG. 1 is an exploded, diagrammatic, perspective view, showing an embodiment of a compartmentalized dynamic mixing apparatus according to the present invention;

FIG. 2 is a sectional view taken generally along the line 2—FIG. 1;

FIG. 3 is a diagrammatic, perspective view, showing the manner of removing the top of the embodiment of the invention illustrated in FIGS. 1 and 2;

FIG. 4 is a diagrammatic, perspective view, showing the manner in which a wrench can be used to exert an opening force on the barrier element of the embodiment of the invention illustrated in FIGS. 1 and 2;

FIG. 5 is a diagrammatic, perspective view, similar to FIG. 1, but showing a second embodiment of a compartmentalized mixing apparatus according to the present invention;

FIG. 6 is a diagrammatic, perspective view, similar to FIG. 5, but showing a wrench being used for rotating a severed barrier element of this embodiment of the present invention;

FIG. 7 is a diagrammatic, top plan view, showing the embodiment of FIGS. 5 and 6 with the severed barrier elements removed and a suitable specimen arranged within the container for embedment within the contents of the container;

DESCRIPTION OF THE PREFERRED EMBODIMENTS

Figure 8:
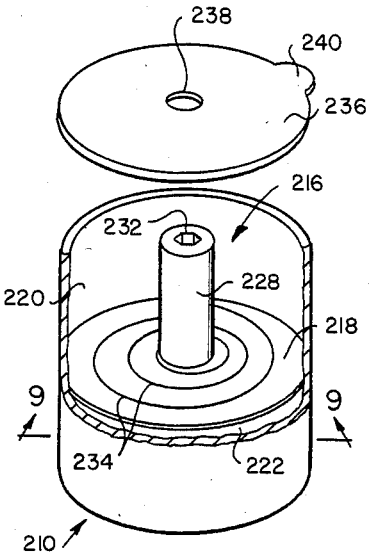
FIG. 8 is an exploded, diagrammatic, perspective view, partly broken away and in section, showing yet another embodiment of compartmentalized mixing apparatus according to the present invention.

Referring now more particularly to FIGS. 1 and 2 of the drawings, apparatus for storing and selectively mixing at least two distinct substances comprises a container 10 including a bottom wall 12 and a, for example, substantially cylindrical side wall 14 arranged for forming a substance holding chamber 16. Arranged within chamber 16 of container 10 is a barrier 18 which separates chamber 16 into at least two compartments 20 and 22. Each of the compartments 20, 22 holds a predetermined quantity of a known fluent substance 24, 26 different from a substance 26, 24 being held in the other of the compartments 22, 20. Although only two compartments are shown as formed within chamber 16 of container 10, it is to be understood that any number of compartments could be formed merely by adding additional branches to barrier 18 as desired.

Barrier 18 normally is attached to walls 12 and 14 of container 10 for dividing chamber 16 of container 10 into the aforementioned at least two compartments 20, 22. Associated with barrier 18 is a combining arrangement arranged for permitting selective communication with one another by an external force of the compartments 20, 22 formed by barrier 18 within the chamber 16 of container 10, and allowing a substance 24, 26 within each of the compartments 20, 22 to intermix with a substance 26, 24 from the compartment 22, 20. Stated otherwise, the combining arrangement permits selective opening of barrier 18 with respect to container 10.

As seen in FIGS. 1 and 2, barrier 18 includes an actuator operable by an external force as to be discussed below, for permitting selective opening of barrier 18 with respect to container 10, and includes a hub 28 from which extend at least two blades 30. These blades 30, which need not be symmetrical as illustrated, also form for the apparatus according to the present invention illustrated in FIGS. 1 and 2 a mixing arrangement actuable by an external force for blending each substance 24, 26 with one another. The actuator includes a socket 32 provided in hub 28 and arranged opening externally of container 10 for receiving a tool which facilitates twisting, or rotation, of barrier 18 relative to container 10 and causing the desired separation. Tear line 34 can be provided along the peripheral portions of blades 30, where they attach to side wall 14, as well as to bottom wall 12, for facilitating severance of barrier 18 from container 10.

It is to be understood that connection of barrier 18 to wall 12 or 14 of container 10 could also be done by a suitable adhesive which will tear away in the desired manner.

Container 10 includes a top 36 which may be constructed from a flexible material and provided with a suitable, known contact adhesive around the peripheral portions on one side thereof as is conventional with "pull-off" closures. Centrally located in top 36 is an opening 38 which permits a severing tool to be inserted into socket 32, which is in alignment with opening 38. An adhesive also is across top 36 in the one side thereof and around opening 38, and the socket 32 is illustrated as recessed, or depressed, relative to an upper surface 41 of barrier 18 so as to facilitate sealing of top 36 around opening 38 and along upper surface 41. A tab 40 provided on top 36 facilitates removal thereof from side wall 14 of container 10, as illustrated in FIG. 3.

As can be seen from FIG. 4 of the drawings, the apparatus as seen in FIGS. 1 and 2 can be mixed by insertion of a conventional wrench 42, and the like, through opening 38 and into socket 32 (not shown in FIG. 4) and a twisting or rotary motion applied to wrench 42 as indicated by the arrow in FIG. 4 in order to open barrier 18 relative to side wall 14 of container 10 and permit mixing of substances 24 and 26. As can be appreciated, continued rotation of wrench 42 will cause rotation of barrier 18 within container 10 and assure proper mixing of the substances 24, 26.

Referring now more particularly to FIGS. 5–7 of the drawings, apparatus according to the present invention is illustrated which includes a container 110 similar to container 10 and comprising a bottom wall 112 and a substantially cylindrical side wall 114 cooperating to form a chamber 116. Disposed within chamber 116 is a barrier 118 similar to barrier 18, but being of somewhat different configuration. Barrier 118 forms a pair of compartments 120 and 122 similar to compartments 20 and 22. Barrier 118 includes a hub 128 from which extend a pair of symmetrical, opposed arms 130. Formed in hub 128 is a socket 132 opening externally of chamber 116. Arms 130 are attached to side wall 114, as well as to bottom wall 112 in a manner now shown, as by the weakened areas 134 so as to facilitate the desired severing of barrier 118 from container 110. A wrench 142 can be inserted into socket 132 in a similar manner to wrench 42 and socket 32 so as to permit severing of barrier 118 and opening of compartments 120 and 122 to one another. Further, barrier 118 will also function as a mixing element by continued rotation of barrier 118 by wrench 142 after separation is achieved.

Although not specifically shown, it is to be understood that container 110 will include a top which can be similar to top 36.

Once separation and mixing of substances (not shown) within compartments 120 and 122 is accomplished, barrier 118 can be removed entirely from chamber 116, and a suitable specimen S inserted into container 110 for embedment within the mixture of the aforementioned substances. For this purpose, the inner surface of side wall 114 is provided with a pair of opposed grooves 144 which will hold the specimen in place until the mixture solidifies, or cures.

Figure 9:
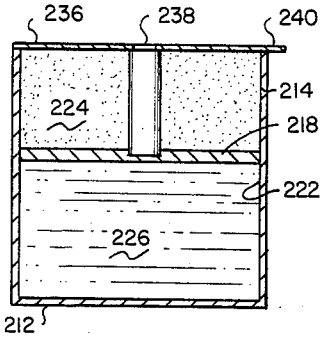
FIG. 9 is a diagrammatic, sectional view, taken generally along the line 9—9 of FIG. 8.

FIGS. 8 and 9 illustrate an embodiment of the present invention wherein a container 210 formed from a bottom wall 212 and a generally cylindrical side wall 214 forms a chamber 216 in which is disposed a generally horizontal barrier 218 dividing chamber 216 into an upper compartment 220 and a lower compartment 222. Each of the aforementioned compartments 220, 222, contains a predetermined amount of a specified substance 224, 226, respectively. Substance 224 is illustrated as a powder or granulated material to illustrate the use of such substances with the present invention. Barrier 218 includes a generally vertically disposed stem 228 extending toward the top portion of container 210 and provided with a socket 232 arranged for receiving a suitable wrench (not shown) and the like. A tear line 234, also made as by scoring with a sharp blade (not shown) in a conventional manner, is arranged spiral fashion along the generally disc-shaped portion of barrier 218 in order to facilitate separation of barrier 218 and opening of compartments 220 and 222 to one another. As will be appreciated, the spiral separation of barrier 218 will cause parts of same to drop downwardly into compartment 222, so that subsequent rotation of stem 228 will cause a mixing action within chamber 216 in a manner not shown. With this arrangement, substance 226 could be even a solid dissolvable in a liquid substance 224.

Container 210 is provided with a top 236 which can be an adhesive-type of top in the manner of top 36 described above. Top 236 is provided with an opening 238 aligned with socket 232 for permitting insertion of a wrench (not shown) or other suitable tool into socket 232. A tab 240 facilitates removal of top 236 once mixing of substances 224 and 226 is completed.

Figure 10:
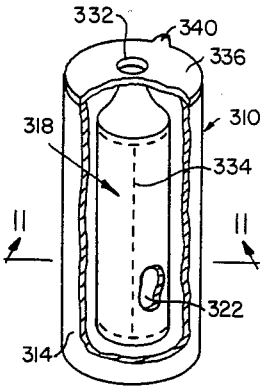
FIG. 10 is a diagrammatic, perspective view, partially broken away and in section, showing a still further embodiment of compartmentalized mixing apparatus according to the present invention.
Figure 11:
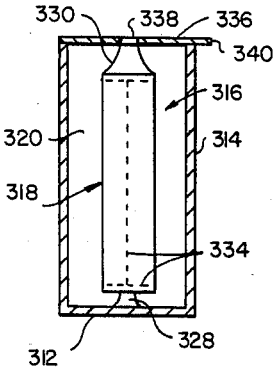
FIG. 11 is a diagrammatic, sectional view, taken generally along the line 11—11 of FIG. 10.

A container 310 is illustrated in FIGS. 10 and 11 of the drawings, which container 310 includes a bottom wall 312 and a side wall 314 which is illustrated as cylindrical, but need not be as will be appreciated from the discussion below. Walls 312 and 314 provide a chamber 316 within container 310, in which chamber 316 is disposed a vessel 318 forming the barrier for this embodiment of apparatus according to the present invention. Vessel 318 forms itself a compartment 320, with the area of chamber 316 external of vessel 318 forming a second compartment 322. Vessel 318 is affixed to bottom wall 312 of container 310 as by the illustrated pedestal 328, and extends away from bottom wall 312 to a top portion 330 thereof in which a socket 332 is defined opening away from bottom wall 312. In the generally cylindrical vessel 318 illustrated, tear lines 334 are provided for opening vessel 318 when same is twisted about the point of attachment at pedestal 328 of vessel 318 to bottom wall 312 of container 310. More specifically, the generally cylindrical vessel 318 has a pair of spaced ends each having a circumference, and the tear lines 334 include scored or weakened portions extending generally around the circumference of each of the spaced ends of vessel 318, and a further weakened or scored portion extending between the weakened part at the spaced ends.

Container 310 is provided with a top 336 which can be similar in construction to tops 36 and 236, and provided with a central opening 336 permitting passage of a wrench or other suitable tool in a manner as discussed above for twisting vessel 318 about pedestal 328 and causing vessel 318 to open in order to mix the substances contained within compartments 320 and 322. As will be appreciated, the remnants of vessel 318 once opened will cause mixing of the substances within chamber 316 by continued rotation of a tool inserted into socket 332. A tab 340 is provided on top 336 for facilitating removal of top 336 once the substances within chamber 316 have been thoroughly mixed and to permit the mixture to be poured into whatever location desired.

Figure 12:
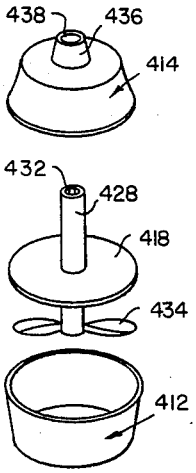
FIG. 12 is an exploded, diagrammatic, perspective view, showing another embodiment of compartmentalized mixing apparatus according to the present invention.
Figure 13:
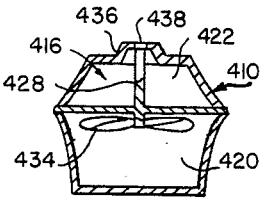
FIG. 13 is a diagrammatic, vertical sectional view, showing the embodiment of the invention illustrated in FIG. 12.
Figure 14:
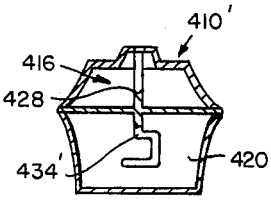
FIG. 14.is a diagrammatic, vertical sectional view, similar to FIG. 13, but showing a modified mixing device.

FIGS. 12 and 13 illustrate an embodiment of the present invention wherein apparatus for mixing two or more components comprises a container 110 formed by a bottom part 412 and a separate, and similarly configured, top part 414. When placed together, the parts 412 and 414, each of which is in the form of a frustum of a cone, create a chamber 416. Disposed between the junction of parts 412 and 414 is a barrier 418 in the form of a thin film or foil constructed from a suitable material, such as polyethylene and aluminum. This barrier 418 creates a top compartment 420 and a bottom 422, each containing a predetermined amount of a substance (not shown). In this embodiment, the mixing device is separate from the barrier 418, and includes in part a stem 428 attached to both a mixing element and to the barrier 418. As illustrated, stem 428 is integral with barrier 418 and arranged for selectively receiving an internal force, as by insertion of a wrench (not shown) or other suitable tool in a socket 432 provided in stem 428 and arranged opening externally of container 410 for selectively receiving an external force and initially separating barrier 418 from container 410, and subsequently actuating the mixing element. In the illustrated embodiment, the mixing element is in the form of a propeller 434 disposed beneath barrier 418 and within bottom part 412 of container 410.

Top part 414 includes in the base portion thereof a boss 436 provided with an opening 438 through which access to socket 432 is obtained. Once the substances contained therein are mixed, parts 412 and 414 can be separated in a suitable, known manner in order to permit pouring of the mixture into a mold (not shown) or other receptacle as desired.

Although a propeller 434 is illustrated in FIGS. 12 and 13 as a separate mixing device, it is to be understood that any suitable mixing element can be employed. For example, FIG. 15 shows an arrangement wherein a container 410', similar to container 410, is provided with a formed wire mixer 434' as the mixing element.

As can be readily understood from the above description and from the drawings, compartmentalized dynamic mixing apparatus according to the present invention permits even fairly large quantities of two or more fluent substances to be mixed in an efficient manner in the same container in which the substances are packaged and stored. While the materials used to construct the present invention may vary, it has been found satisfactory to employ conventional foil and films to construct the severable barriers. Alternatively, the barrier as well as its associated containers can be molded as a single piece from, for example, polyethylene or a similar material with weakened portions provided in the areas where separation is to take place. The orientation of the barriers themselves can vary, with any angle of the barrier surface between vertical and horizontal being possible, as desired.

Although a number of forms and modifications have been described, it will be appreciated that the invention is not limited thereto but encompasses all variations within the scope of the appended claims.

What is claimed is:

1. Apparatus for storing and selectively mixing at least two distinct substances, comprising in combination:

A. container means for creating a substance holding chamber;

B. barrier means arranged within the chamber of the container means and normally attached thereto for separating the chamber into at least two compartments, each of the compartments holding a quantity of a substance different from a substance being held in each of the other of the compartments; and C. combining means connected to the barrier means for selectively applying a twisting motion to the barrier means and separating the barrier means completely from the container means, permitting the selective communication with one another by an external force of the compartments formed by the barrier means within the chamber of the container means, and allowing a substance within each of the compartments to intermix with a substance from each of the other compartments formed by the barrier means.

2. Apparatus as defined in claim 1, wherein the combining means includes actuator means operable by an external force for permitting selective opening of the barrier means with respect to the container means.

3. Apparatus as defined in claim 1, wherein the combining means further includes tear means associated with the barrier means for facilitating opening of the barrier means with respect to the container means.

4. Apparatus as defined in claim 3, wherein the combining means includes external force operable actuator means for permitting selective opening of the barrier means with respect to the container means.

5. Apparatus as defined in claim 3, wherein the actuator means includes the barrier means comprising an element provided with a socket opening externally of the container means and arranged for receiving a tool which facilitates twisting of the barrier means relative to the container means and causing the desired opening of the barrier means.

6. Apparatus as defined in claim 1, wherein the container means includes mixing means actuable by an external force for blending each substance with any other substance within the container means.

7. Apparatus as defined in claim 6, wherein the barrier means forms the mixing means.

8. Apparatus as defined in claim 6, wherein the mixing means is separate from the barrier means.

9. Apparatus as defined in claim 8, wherein the combining means includes a stem attached to both the mixing means and the barrier means, the stem being arranged for selectively receiving an external force and initially opening the barrier means, and subsequently actuating the mixing means.

10. Apparatus as defined in claim 9, wherein the stem has a longitudinal extent, and is provided with a socket opening externally of the container means and arranged for receiving a tool which facilitates rotation of the stem about the longitudinal extent thereof.

11. Apparatus as defined in claim 1, wherein the barrier means includes a vessel disposed within the chamber of the container means, the vessel arranged forming one of the compartments of the chamber.

12. Apparatus as defined in claim 11, wherein the combining means includes tear means associated with the vessel for facilitating opening of the vessel as desired.

13. Apparatus as defined in claim 12, wherein a point on the vessel is affixed to the container means, the tear means being provided on the vessel and arranged for opening the vessel when the vessel is twisted about the point of attachment of the vessel to the container means.

14. Apparatus as defined in claim 13, wherein the vessel has the generally cylindrical configuration with a pair of spaced ends each having a circumference, and the tear means includes weakened portions around the circumference of each of the spaced ends of the vessel, and a further weakened portion extending between the weakened portions disposed at the spaced ends.

15. Apparatus as defined in claim 14, wherein the vessel is provided with a socket opening externally of the container means and arranged for receiving a tool which facilitates twisting of the vessel above the point of affixment thereof to the container means.

16. Apparatus as defined in claim 1, wherein the container means is provided with a side wall having formed thereon and arranged opening inwardly of the chamber of the container means a pair of opposed grooves exposed for retainingly receiving a specimen to be embedded in a mixture held in the chamber of the container means.

* * * * *